US008666080B2

(12) United States Patent
Hain et al.

(10) Patent No.: US 8,666,080 B2
(45) Date of Patent: Mar. 4, 2014

(54) METHOD FOR PROCESSING A MULTI-CHANNEL AUDIO SIGNAL FOR A BINAURAL HEARING APPARATUS AND A CORRESPONDING HEARING APPARATUS

(75) Inventors: Jens Hain, Kleinsendelbach (DE); Robert Kasanmascheff, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 1009 days.

(21) Appl. No.: 12/288,737

(22) Filed: Oct. 23, 2008

(65) Prior Publication Data

US 2009/0110220 A1 Apr. 30, 2009

(30) Foreign Application Priority Data

Oct. 26, 2007 (DE) ..... 10 2007 051 308

(51) Int. Cl.
*H04R 5/00* (2006.01)

(52) U.S. Cl.
USPC ..... 381/17; 381/1; 381/22; 381/60; 381/310; 381/313

(58) Field of Classification Search
USPC ..... 381/1, 17, 22, 60, 310, 313
See application file for complete search history.

(56) References Cited

U.S. PATENT DOCUMENTS 4,388,494 A * 6/1983 Schone et al. ..... 381/1
5,742,689 A * 4/1998 Tucker et al. ..... 381/17
6,498,857 B1 * 12/2002 Sibbald ..... 381/310
6,741,706 B1 * 5/2004 McGrath et al. ..... 381/22
6,771,778 B2 * 8/2004 Kirkeby ..... 381/17
7,313,241 B2 * 12/2007 Hamacher et al. ..... 381/60
7,539,319 B2 * 5/2009 Dickins et al. ..... 381/310
2006/0198527 A1 * 9/2006 Chun ..... 381/17
2007/0223751 A1 9/2007 Cartwright
2007/0269064 A1 * 11/2007 Allegro-Baumann et al. ..... 381/313
2008/0137870 A1 * 6/2008 Nicol et al. ..... 381/17

FOREIGN PATENT DOCUMENTS

DE 19910372 A1 11/1999
EP 0932324 A2 7/1999
WO WO 2004/114722 * 12/2004 ..... H04R 25/00
WO WO 2007031896 A1 3/2007

* cited by examiner

*Primary Examiner* — Cuong Q Nguyen
*Assistant Examiner* — Galina Yushina
(74) *Attorney, Agent, or Firm* — Laurence A. Greenberg; Werner H. Stemer; Ralph E. Locher

(57) ABSTRACT

Wearers of hearing apparatuses and in particular of hearing device systems having two speakers are to be able to enjoy the experience of spatial multi-channel reproduction. Provision is accordingly made to generate a dual-channel audio signal for a binaural hearing apparatus comprising a multi-channel audio signal having at least three individual channels. Accordingly at least one spatial impression-influencing signal level in at least one of the individual channels is changed, and a signal of at least one of the individual channels is connected with signals of the remaining individual channels to the dual-channel audio signal. A corresponding hearing apparatus and in particular a corresponding hearing device have a transformation system that takes over this preprocessing from the multi-channel audio signal to the dual-channel audio signal.

9 Claims, 2 Drawing Sheets

METHOD FOR PROCESSING A MULTI-CHANNEL AUDIO SIGNAL FOR A BINAURAL HEARING APPARATUS AND A CORRESPONDING HEARING APPARATUS

CROSS REFERENCE TO RELATED APPLICATIONS

This application claims priority of German application No. 10 2007 051 308.0 DE filed Oct. 26, 2007, which is incorporated by reference herein in its entirety.

FIELD OF INVENTION

The present invention relates to a method for generating a dual-channel audio signal for a binaural hearing apparatus. The present invention furthermore also relates to a corresponding hearing apparatus with two speakers for binaural supply. The term "hearing apparatus" is understood here to mean any device that reproduces sound, which can be worn in or on the ear, in particular a hearing device, a headset, a set of ear phones and the like.

BACKGROUND OF INVENTION

Hearing devices are wearable hearing apparatuses which are used to assist the hard-of-hearing. In order to accommodate numerous individual requirements, various types of hearing devices are available such as behind-the-ear (BTE) hearing devices, hearing device with external receiver (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

SUMMARY OF INVENTION

Watching television or listening to music is a frequently-occurring application for many hearing device wearers. Here the spatial acoustics frequently make it difficult to understand speech or reduce the perceived sound quality by convolving the signal with the spatial impulse response. Particular difficulties with understanding speech arise in echoing spaces.

Furthermore the localization ability is frequently reduced in the case of BTE hearing device wearers, since the hearing device microphones are positioned over the concha (pinna) and do not have the transmission properties of the pinna, which are required for accurate localization. There are increased front-rear and rear-front confusions in this situation. Thus the advantages of a spatial multi-channel reproduction (e.g. 5.1 Dolby surround sound in a home cinema) remain inaccessible to the hearing device wearer.

Direct transmission of the audio material into the hearing device via a radio link is known to assist with interfering spatial acoustics. In this respect FM transmission has proven to be helpful with regard to understanding speech, as has the connection of audio devices to the hearing device via an audio shoe. In this direct transmission each hearing device receives just one mono audio channel. Although in the case of binaural supply a stereo data flow can be sent, each hearing device extracts only one channel with the aid of its audio receiver.

The object of the present invention is thus to improve the spatial impression when presenting acoustic signals by means of speakers in or on the ear.

This object is inventively achieved by means of a method for generating a dual-channel audio signal for a binaural hearing apparatus comprising a multi-channel audio signal having at least three individual channels, by providing the multi-channel audio signal, by changing at least one spatial impression-influencing signal level in at least one of the individual channels, and by connecting a signal of at least one of the individual channels with signals of the remaining individual channels to the dual-channel audio signal.

A hearing apparatus is also provided in accordance with the invention, said hearing apparatus having two speakers for binaural supply and a transformation system for generating a dual-channel audio signal for both speakers comprising a multi-channel audio signal having at least three individual channels in accordance with the method described above.

It is thus advantageously possible to provide improved spatial acoustics by means of two speakers. In particular, especially-desired spatial acoustics can be simulated when using the hearing apparatus, irrespective of the actual spatial acoustics.

The change in at least one signal level preferably takes place with the aid of a head transmission function, which represents an acoustic transmission function from a specified position in space relative to an ear, taking into consideration a skull. The acoustic effect of the skull and/or of the pinna is taken into consideration in the electrical signal, which ultimately leads to improved natural perception.

In particular the head transmission function can be related to a standard head. With a standard or average head of this kind (e.g. a KEMAR mannequin) it is not necessary to enter the individual geometry of the hearing apparatus wearer's head into the transmission function; an estimate of the head transmission function is instead performed, which provides for a faster and simpler configuration of the hearing apparatus.

Changing at least one signal level can be performed for example by adaptive filtering, in which the position and/or orientation of the hearing apparatus wearer in a space is taken into consideration. In this way it is possible to alter the reproduction in the space according to the movement of the wearer, whereby in turn an improved natural impression can also be achieved in dynamically-changing positions.

The changed signal level can be a statistical signal level for example. Thus for example the diffusivity of the sound can only be changed via two channels for perception of a multi-channel sound. In particular the local diffusivity, in other words the uniformity of sound arriving at a particular location from a sound arrival direction, but also the temporal diffusivity, in other words the distribution over time of sound signals at the point of measurement, can be influenced. However interaural levels and/or time differences can also be changed in order to influence the spatial impression in a desired manner. This means that not only complete head transmission functions must be used in order to cause a certain spatial impression, but that individual features that influence the spatial impression can also be changed.

In a special embodiment the hearing apparatus can be worn on the head and the transformation system is integrated in the hearing apparatus. This means that the hearing apparatus can itself record a multi-channel audio signal and process said signal for improved spatial perception.

Alternatively the transformation system is physically separate from the hearing apparatus and realized so as to transmit the dual-channel audio signal wirelessly to the hearing apparatus. Consequently energy can be saved in the hearing apparatus itself for the multi-channel receipt and multi-channel processing (multi-channel here means three or more channels). Single- or dual-channel processing in the hearing apparatus is then sufficient.

The hearing apparatus can be embodied especially as a hearing device. In this way it is also possible to afford a hearing device wearer the advantages of multi-channel reproduction (e.g. 5.1 surround sound).

BRIEF DESCRIPTION OF THE DRAWINGS

The present invention is described in more detail with reference to the appended drawings, in which.

DETAILED DESCRIPTION OF INVENTION

The exemplary embodiments shown in more detail below represent preferred embodiments of the present invention.

Figure 1:
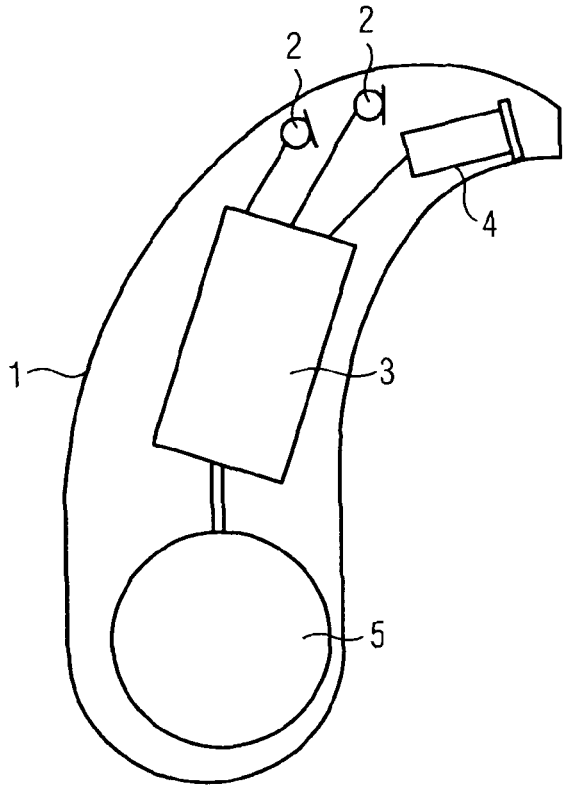
FIG 1 (Prior art)
FIG. 1 shows the basic design of a hearing device according to the prior art.
Figure 2:
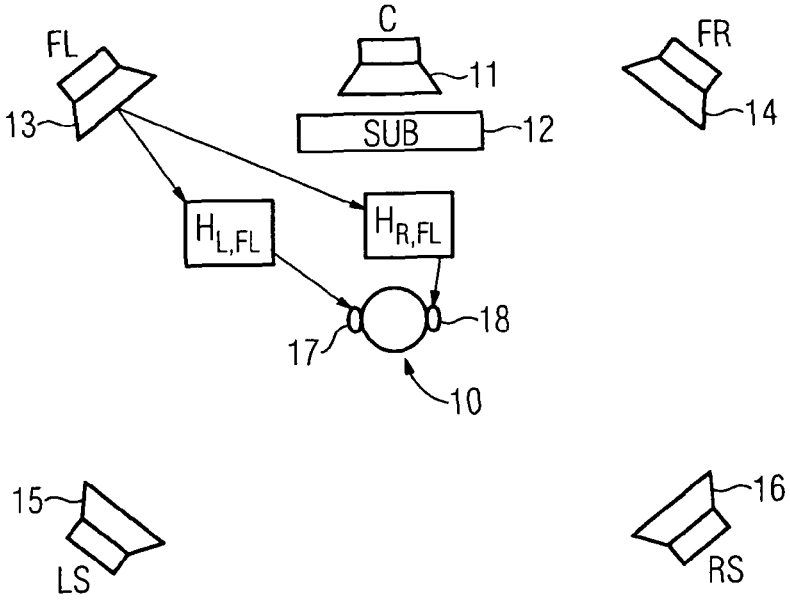
FIG. 2 shows the arrangement of a 5.1 multi-channel reproduction system with acoustic paths.

FIG. 2 shows a schematic representation of the acoustic situation of 5.1 multi-channel reproduction. Five speakers and a subwoofer are positioned separately in a space. A central speaker 11 and a subwoofer 12 are positioned in a directly forward direction relative to a listener whose head 10 is shown schematically. The central speaker 11 is actuated with a channel audio signal C and supplies an acoustic component. The subwoofer 12 actuated with a channel audio signal SUB generates a further acoustic component. A front-left speaker 13 arranged at the front left provides an acoustic component on the basis of a channel audio signal FL and a front-right speaker 14 arranged at the front right provides an acoustic component on the basis of a channel audio signal FR. Finally a left-surround speaker 15 arranged at the rear to the left provides an acoustic component on the basis of a channel audio signal LS and a right-surround speaker 16 arranged at the rear to the right provides an acoustic component on the basis of a channel audio signal RS. Each of these individual acoustic components has a characteristic, possibly time-variable transmission function from the corresponding speaker to the left ear 17 or the right ear 18. To provide a general overview, FIG. 2 indicates only the transmission function $H_{L,FL}$ from the front-left speaker 13 to the left ear 17 and the transmission function $H_{R,FL}$ from the front-left speaker 13 to the right ear 18.

Provision is now made according to the present invention for a preprocessing of the multi-channel audio data that generally serves to actuate the individual speakers 11, 13, 14, 15, 16 and the subwoofer 12. In the specific exemplary embodiment a filtering of the multi-channel data with average head transmission functions $H_{L,FL}$, $H_{R,FL}$ etc. is performed. An "average head transmission function" is defined here as a transmission function from a speaker to an average (e.g. KEMAR) head. If necessary the transmission functions can be smoothed in order to supply a greater number of people with a satisfactory result. Here the head transmission function impresses on the audio signal an item of spatial orientation information, which is also perceived as such in the case of direct transmission into the hearing device. This preprocessing then makes it possible to reduce the multi-channel audio tracks (e.g. six-channel audio data flow) to a dual-channel audio data flow. An audio data flow reduced in this way can then be transmitted wirelessly and/or by wire to the hearing devices or other hearing apparatuses using reduced energy expenditure.

Figure 3:
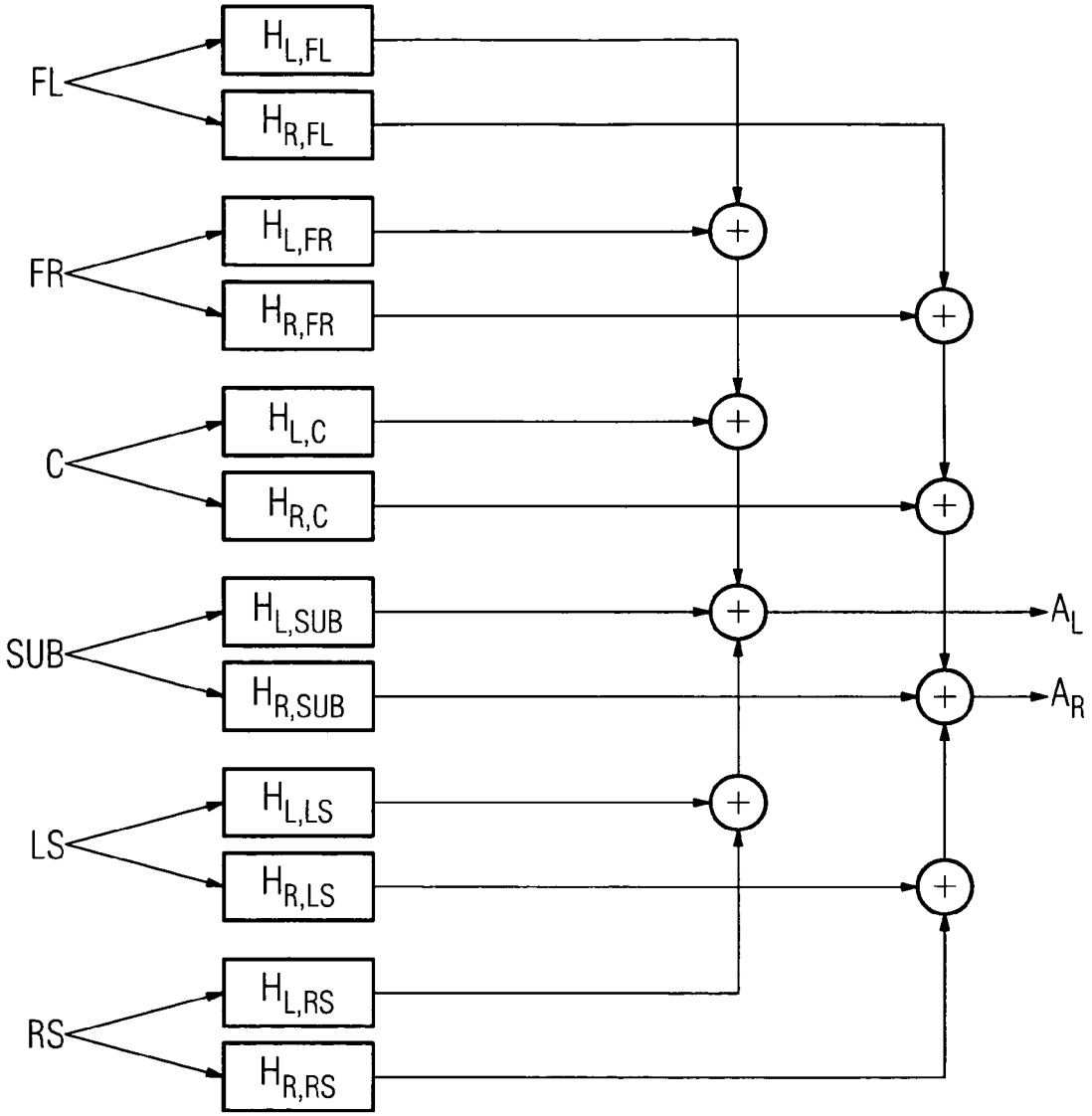
FIG. 3 shows the filtering of 5.1 multi-channel information with head transmission functions and the formation of a stereo signal for transmission to a hearing device.

FIG. 3 shows a schematic view of the transformation and filtering of an item of multi-channel information (here also for a 5.1 system) in order to form a stereo signal for transmission to a hearing device. In accordance with the example from FIG. 2 the multi-channel audio signal for the six individual channels comprises the channel audio signals FL, FR, C, SUB, LS and RS. Therefore twelve filters are provided in the context of preprocessing, each of which represents a transmission function according to the transmission path from the relevant speaker to the left or right ear 17, 18. For the front-left speaker 13 that is actuated with the channel audio signal FL, this results for the left ear 17 for example in the transmission function $H_{L,FL}$, and for the right ear 18 in the transmission function $H_{R,FL}$. For the channel audio signal FR that serves to actuate the front-right speaker 14, this results analogously in the transmission function $H_{L,FR}$ to the left ear and the transmission function $H_{R,FR}$ for the transmission to the right ear. For the remaining channel audio signals C, SUB, LS and RS this accordingly also results in the transmission functions shown in FIG. 3 in each case from the relevant speaker to the left or right ear. Thus the filters for the right ear here supply six filter signals that are additively combined and that lead to the right output signal $A_R$. Similarly the six left filter signals are joined into one left output signal $A_L$. As a signal level for example the amplitude or phase or more-complex values such as the diffusivity of a signal are influenced by means of the filters. A dual-channel audio data flow, in which the acoustic features of the head 10 are taken into consideration, thus results from the six-channel audio data flow by means of the preprocessing.

The filters used for preprocessing can also be adaptive and/or time-variable. It is therefore possible to take into consideration the current position of a hearing device wearer during filtering. This can be used for example to change the sound impression when the hearing device wearer moves his/her head. This adaptivity of the filters can possibly be turned on and off.

In other words a preprocessing of multi-channel audio tracks is provided whereby the spatial information from several spatial directions is retained in one stereo data flow or two mono data flows. Conventional transmission methods can be used here and additional processing steps are not necessary.

A particularly advantageous feature of the preprocessing according to the invention is that a hearing device wearer can enjoy the experience of spatial multi-channel reproduction. Interfering influences from the spatial acoustics can be avoided in this way. The need to set up those speakers that would otherwise be required for multi-channel reproduction is further obviated. Thus for multi-channel reproduction it is not necessary to provide the space for speakers that is otherwise required. Furthermore the area in larger public areas, within which a balanced perception is provided from all directions, is frequently limited to a few seat positions. These spatial limitations no longer apply on account of the present invention, since the inventive multi-channel reproduction with the aid of a stereo signal is independent of the seat position, and therefore seats can also be used that are located directly in front of a wall. The result is an application that also has distinct advantages for those with normal hearing. An application in movie theaters would also have the advantage of independent seat positioning and undisturbed transmission of audio material. However real spaces such as churches, outdoor environments, etc. can also be better acoustically simulated.

The preprocessing can in principle be performed directly in the hearing apparatus and especially in the hearing device. However a multi-channel transmission to the hearing apparatus is then necessary. Otherwise the preprocessing takes place in an external device, e.g. a so-called "set-top box", so that just one more dual-channel transmission of the preprocessed audio flow to the hearing apparatus is required.

The invention claimed is:

1. A hearing apparatus, comprising:

two speakers for binaural supply for presenting acoustic signals to a user wearing the hearing apparatus on the head, the speakers adapted for positioning on a pair of ears of the user; and a transformation system for generating a dual-channel audio signal comprising a left audio signal and a right audio signal from a multi-channel audio signal having at least three individual channels representing acoustic signals located separately in space having spatial information from several spatial directions, the left audio signal connected to one of the two speakers for output, the right audio signal connected to another of the two speakers for output;

wherein a position of a hearing apparatus wearer is changed, the transformation system modifies the left and right audio signal creating an impression of a change in a user position in a virtual surrounds of the above individual channel is divided into left and right signals each of which is transformed via a corresponding head transmission function (HRTF) related to a standard head, and a combined signal of all transformed left signals and a combined signal of all transformed right signals are provided, correspondingly, to the left and right speakers of the binaural bearing apparatus.

2. The hearing apparatus as claimed in claim 1, wherein the transformation system is integrated in the hearing apparatus.

3. The hearing apparatus as claimed in claim 1, wherein the transformation system is physically separate from the hearing apparatus and transmits the dual-channel audio signal wirelessly to the hearing apparatus.

4. A method for generating a dual-channel audio signal for a binaural hearing apparatus from a multi-channel audio signal having at least three individual channels, the binaural hearing apparatus adapted to be worn on the head of a wearer comprising a left speaker and right speaker adapted for positioning, correspondingly, on a left ear and on a right ear of the wearer, the method comprising:

receiving a multi-channel audio signal having at least three individual channels located separately in space;

wherein a position of the hearing apparatus wear is changed, at least one spatial impression-influencing signal level of a transformation system is changed, wherein the transmission system divides audio signals from each of the individual channels into left and right audio signals delivered to the left speaker and to the right speaker of the wearer, and wherein the transformation system is based on head transmission functions of standard head, each transmission function takes into account an acoustic transmission path from the corresponding individual channel to the left ear or to the right ear of the wearer; and connecting each of the left and right audio signals of at least one of the individual channels respectively with each left and right audio signals of the remaining individual channels to generate the dual-channel audio signal; and outputting the dual-channel audio signal respectively to the left and right speaker of the binaural hearing apparatus.

5. The method as claimed in claim 4, wherein the changing of the at least one signal level is performed by adaptive filtering, in which the position and orientation of the hearing apparatus wearer in a space is taken into consideration.

6. The method as claimed in claim 4, wherein the changing of the at least one signal level is performed by adaptive filtering, in which the position or orientation of the hearing apparatus wearer in a space is taken into consideration.

7. The method as claimed in claim 4, wherein the changed signal level is a statistical signal level.

8. The method as claimed in claim 4, wherein the head transmission function takes into consideration a skull for a KEMAR mannequin.

9. The method as claimed in claim 8, wherein the head transmission function is related to a standard head such that individual geometry of a wearer's head need not be entered allowing for faster configuration of the hearing apparatus.

* * * * *